US010352507B2

(12) United States Patent
Deng et al.

(10) Patent No.: US 10,352,507 B2
(45) Date of Patent: Jul. 16, 2019

(54) MAGNETICALLY MOUNTABLE LED LAMP

(71) Applicant: DONGGUAN PAN AMERICAN ELECTRONICS CO., LTD, DongGuan (CN)

(72) Inventors: Jinsheng Deng, DongGuan (CN); Xiaoyun Zeng, DongGuan (CN); Shilin Tang, DongGuan (CN)

(73) Assignee: DONGGUAN PAN AMERICAN ELECTRONICS CO., LTD., Dongguan (CN)

( * ) Notice: Subject to any disclaimer, the term of this patent is extended or adjusted under 35 U.S.C. 154(b) by 90 days.

(21) Appl. No.: 15/402,309

(22) Filed: Jan. 10, 2017

(65) Prior Publication Data

US 2018/0058638 A1 Mar. 1, 2018

(30) Foreign Application Priority Data

Aug. 30, 2016 (CN) ..... 2016 2 1014325 U

(51) Int. Cl.
*F21K 9/275* (2016.01)
*F21S 8/02* (2006.01)
(Continued)

(52) U.S. Cl.
CPC ..... *F21K 9/275* (2016.08); *F21K 9/272* (2016.08); *F21S 4/28* (2016.01); *F21S 8/026* (2013.01);
(Continued)

(58) Field of Classification Search
CPC .... F21V 21/096; F21V 17/107; F21V 29/767; F21V 3/02; F21V 15/015; F21V 17/105;
(Continued)

(56) References Cited

U.S. PATENT DOCUMENTS 9,488,351 B1 * 11/2016 Szeto ..... F21V 29/00
2011/0286207 A1 * 11/2011 Chan ..... F21V 15/013 362/217.1
(Continued)

FOREIGN PATENT DOCUMENTS

CN 202546443 U * 11/2012
DE 102011076613 A1 11/2012
(Continued)

OTHER PUBLICATIONS

Liu, Aluminum bar lamp, Nov. 21, 2012, Patent Pub CN202546443U; Google Patents, https://patent.google.com/patent/CN202546443U/en.*
(Continued)

*Primary Examiner* — Karabi Guharay
*Assistant Examiner* — Michael Chiang
(74) *Attorney, Agent, or Firm* — Polsinelli PC

(57) ABSTRACT

An LED lamp includes a lamp base; an LED light source module mounted on the lamp base; a transparent lampshade including two resisting sheets extending inwardly from an inner sidewall thereof, the two resisting sheets resisting the LED light source module to position the LED light source module; and two magnets mounted on opposite ends of a bottom surface of the lamp base, respectively; wherein each magnet includes a magnetic head and a connector, the connector includes a shaft and a flange extending outwardly from a periphery of an end of the shaft, the magnetic head has an annular shape and defines an engaging hole, the shaft of the connector extends through the lamp base and the engaging hole, and is connected to the magnetic head, the flange resists a top surface of the lamp base.

9 Claims, 5 Drawing Sheets

(51) Int. Cl.

| | |
|---|---|
| ***F21V 21/096*** | (2006.01) |
| ***F21S 4/28*** | (2016.01) |
| ***F21V 29/76*** | (2015.01) |
| ***F21K 9/272*** | (2016.01) |
| ***F21S 8/04*** | (2006.01) |
| ***F21V 3/02*** | (2006.01) |
| ***F21V 15/015*** | (2006.01) |
| ***F21V 17/10*** | (2006.01) |
| ***F21V 19/00*** | (2006.01) |
| ***F21V 23/00*** | (2015.01) |
| *F21K 9/27* | (2016.01) |
| *F21Y 103/10* | (2016.01) |
| *F21Y 115/10* | (2016.01) |
| *F21Y 105/10* | (2016.01) |

(52) U.S. Cl.
CPC ..... *F21S 8/04* (2013.01); *F21V 3/02* (2013.01); *F21V 15/015* (2013.01); *F21V 17/105* (2013.01); *F21V 19/0035* (2013.01); *F21V 21/096* (2013.01); *F21V 23/001* (2013.01); *F21V 29/767* (2015.01); *F21K 9/27* (2016.08); *F21Y 2103/10* (2016.08); *F21Y 2105/10* (2016.08); *F21Y 2115/10* (2016.08)

(58) Field of Classification Search
CPC ..... F21V 19/0035; F21V 23/001; F21Y 2103/10; F21K 9/275; F21K 9/272; F21S 8/04
See application file for complete search history.

(56) References Cited

U.S. PATENT DOCUMENTS

| | | | | |
|---|---|---|---|---|
| 2014/0126199 | A1* | 5/2014 | Heeter | F21V 21/08 362/223 |
| 2015/0077983 | A1* | 3/2015 | Pan | F21V 21/096 362/218 |
| 2015/0078003 | A1 | 3/2015 | Yang | |

FOREIGN PATENT DOCUMENTS

| | | | |
|---|---|---|---|
| GB | 2475067 | A | 5/2011 |
| WO | 2013094816 | A1 | 6/2013 |

OTHER PUBLICATIONS

European Search Report dated May 12, 2017 issued in European Application No. 17161864.8, 9 Pages.

* cited by examiner

MAGNETICALLY MOUNTABLE LED LAMP

FIELD OF THE INVENTION

The present disclosure relates to a technical field of LED lighting, and more particularly, relates to an LED lamp.

BACKGROUND OF THE INVENTION

With a continuous development of society and with an increasing improvement of living conditions, the new energy LED lamp is launched into market rapidly, influencing people's daily life, and because of the advantages of high efficient and energy saving, it replaces a large quantity of incandescent filament lamps, energy saving lamps, and fluorescent lamps. For the fluorescent lamp which is used widely, a large quantity of new energy LED lamps is required to replace the fluorescent lamps. However, in the replacement process, the original lamp panels should be disassembled, and the new lamp panels corresponding to the new energy LED lamps should be assembled, thus the replacement is troublesome, the install is inconvenient, and the labor cost and the invested cost are high.

SUMMARY

Accordingly, it is necessary to provide an LED lamp which is easy to assemble and has a low cost.

An LED lamp includes: a lamp panel mounted on a ceiling; a lamp base having an elongated shape; an LED light source module mounted on the lamp base; a transparent lampshade including two resisting sheets extending inwardly from an inner sidewall thereof, the two resisting sheets resisting the LED light source module to position the LED light source module; and two magnets mounted on opposite ends of a bottom surface of the lamp base, respectively, the two magnets being magnetically and adjustably attached to the lamp panel; wherein each magnet includes a magnetic head and a connector, the connector includes a shaft and a flange extending outwardly from a periphery of an end of the shaft, the magnetic head has an annular shape and defines an engaging hole, the shaft of the connector extends through the lamp base and the engaging hole, and is connected to the magnetic head, the flange resists a top surface of the lamp base.

An LED lamp includes: a lamp panel mounted on a ceiling; a lamp base having an elongated shape; an LED light source module mounted on the lamp base; a transparent lampshade including two latching strips extending inwardly from an inner sidewall thereof; and two magnets positioned on opposite ends of a bottom surface of the lamp base, respectively, the two magnets being magnetically and adjustably attached to the lamp panel; wherein the lamp base defines a receiving groove receiving the LED light source module, and two latching grooves on opposite sides of the receiving groove, the two latching strips engage the two latching grooves; each magnet includes a magnetic head and a connector, the connector includes a shaft and a flange extending outwardly from a periphery of an end of the shaft, the magnetic head has an annular shape and defines an engaging hole, the shaft of the connector extends through the lamp base and the engaging hole, and is connected to the magnetic head, the flange resists a top surface of the lamp base.

Aforementioned LED lamp is consisted by the lamp base, the LED light source module, the transparent lampshade, and the magnets. The LED light source module is positioned in the receiving groove of the lamp base, and is resisted by the transparent lampshade, enabling the LED light source module to be more stable, and the LED light source module is difficult to loose. Because the magnets are assembled to opposite ends of the bottom surface the lamp base, when the fluorescent lamp is disassembled and replaced, merely the fluorescent lamp should be dismantled from the lamp panel, and then the LED lamp is directly assembled. Because the magnets on the lamp base have a strong magnetic attractive force for the lamp panel, thus the lamp base can be absorbed on the lamp panel stably, the assembly of the lamp base is convenient. Thereby, it is cost saving and practical.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Embodiments of the invention are described more fully hereinafter with reference to the accompanying drawings, in which preferred embodiments of the invention are shown. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "fixed to" to another element, it can be directly fixed to the other element or intervening elements may be present. When an element is referred to as being "connected" or "coupled" to another element, it can be directly connected or coupled to the other element or intervening elements may be present.

Unless otherwise defined, all terms used herein have the same meaning as commonly understood by one of ordinary skill in the art to which this invention belongs. Terms in the description of the invention are for the purpose of describing specific embodiments, and are not intend to limit the invention.

Figure 1:
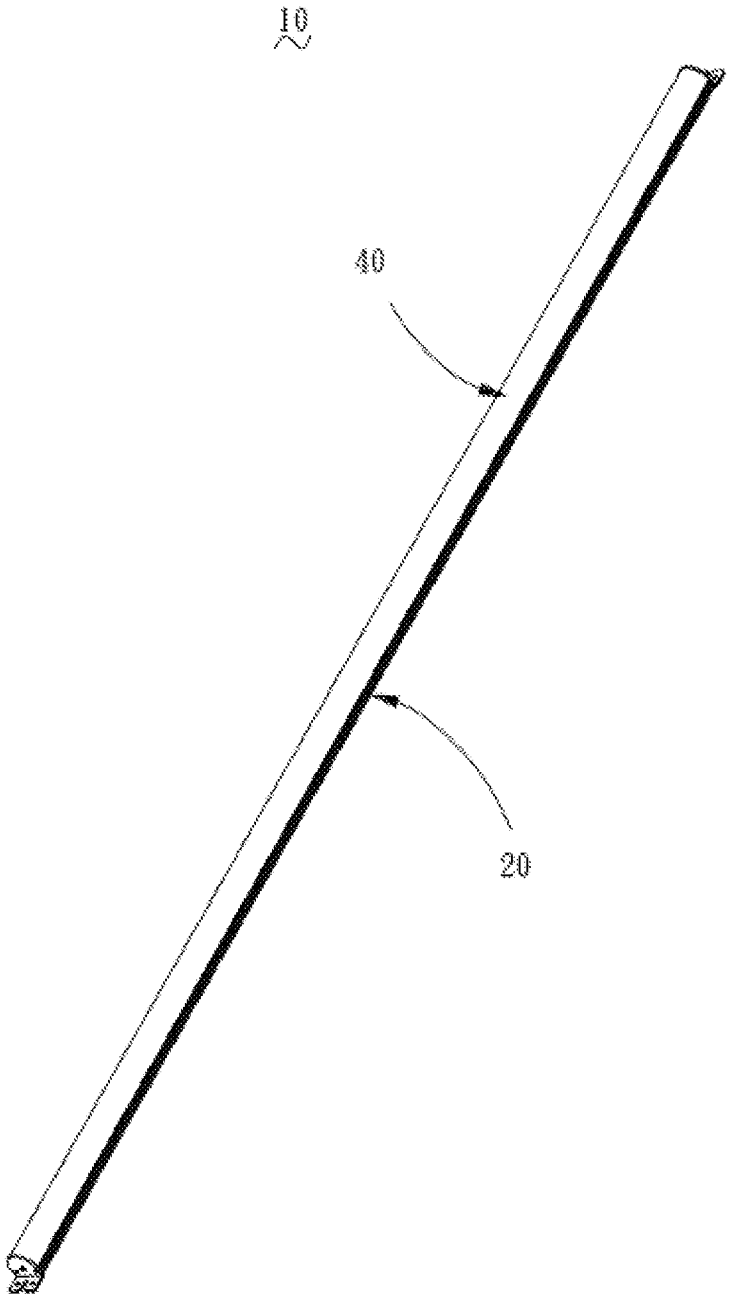
FIG. 1 is a perspective view of an LED lamp according to an embodiment.
Figure 2:
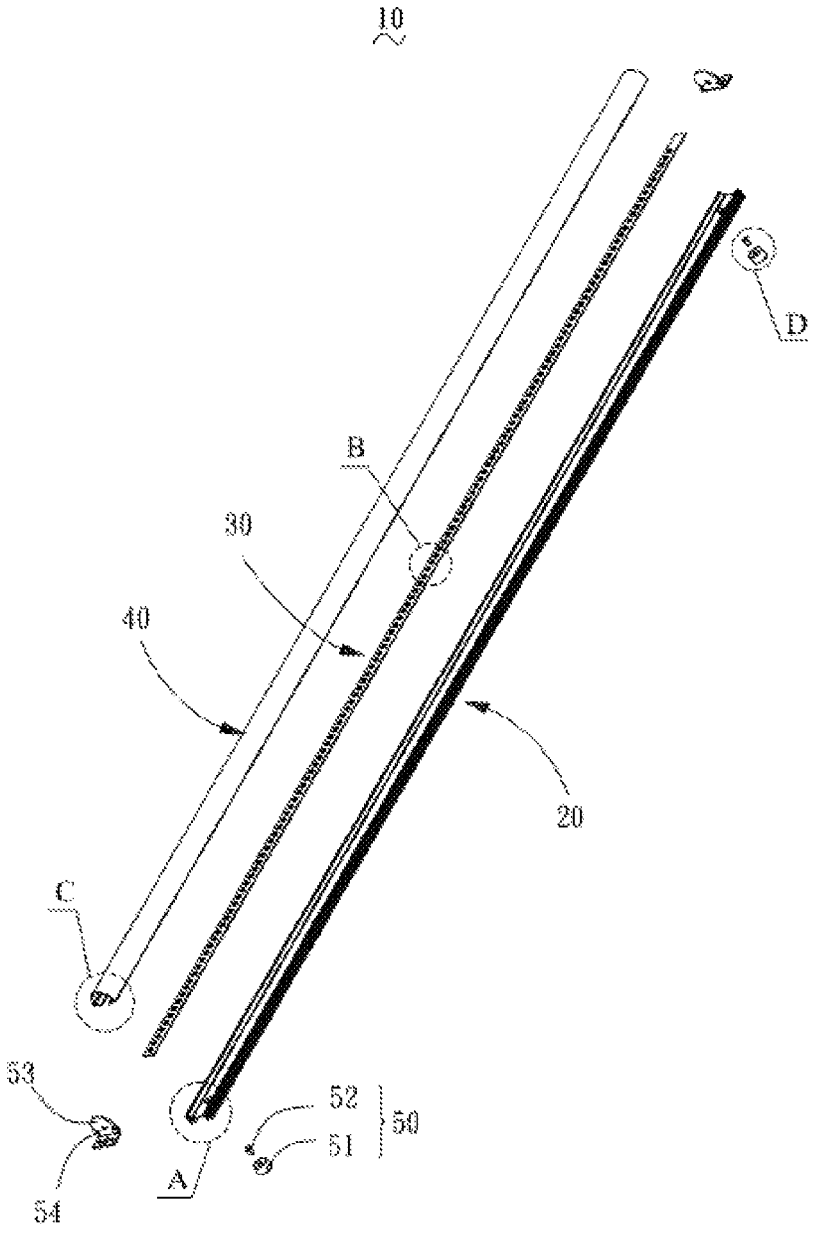
FIG. 2 is an exploded perspective view of the LED lamp of FIG. 1.
Figure 3:
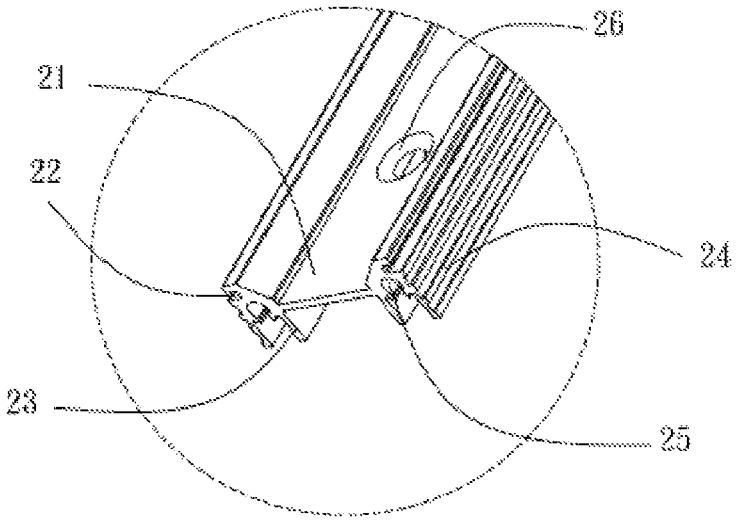
FIG. 3 is an enlarged view of portion A of FIG. 2.
Figure 4:
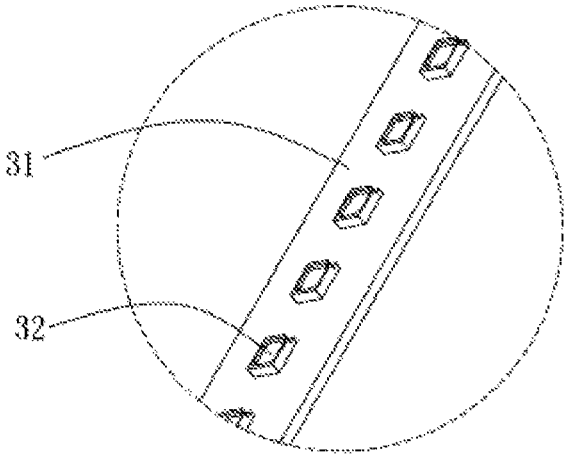
FIG. 4 is an enlarged view of portion B of FIG. 2.
Figure 5:
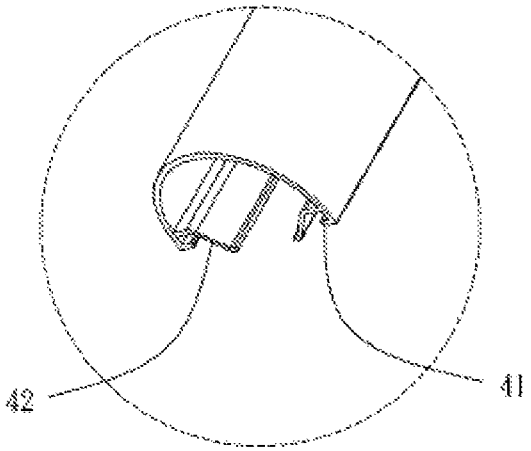
FIG. 5 is an enlarged view of portion C of FIG. 2.
Figure 6:
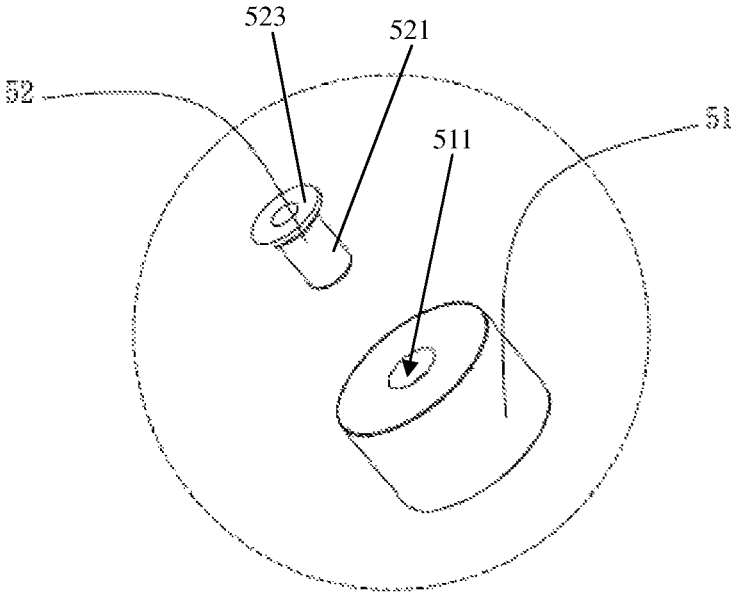
FIG. 6 is an enlarged view of portion D of FIG. 2.
Figure 7:
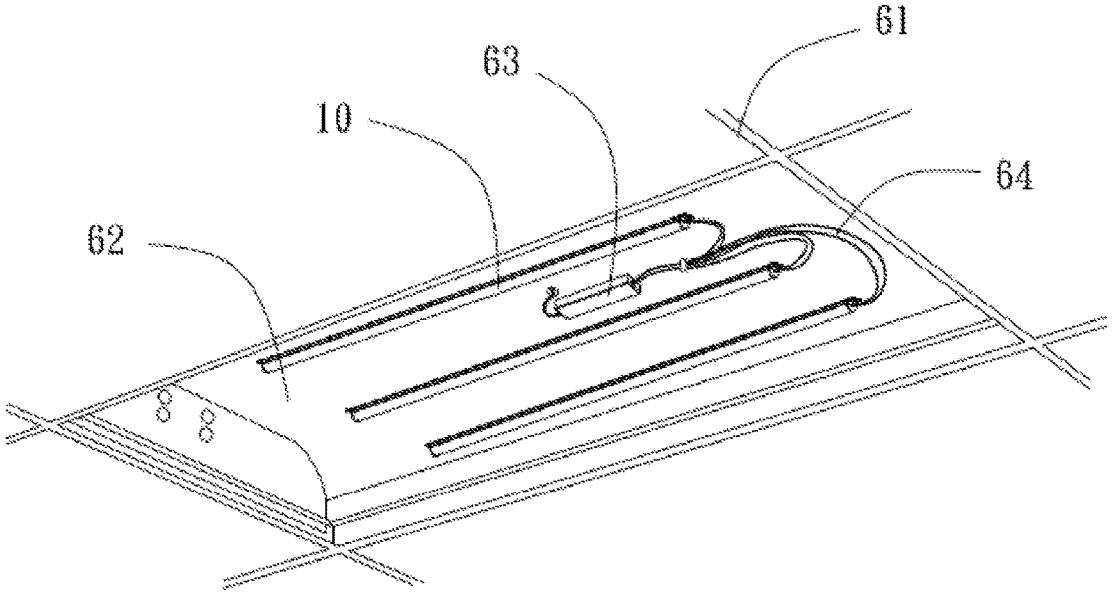
FIG. 7 is a perspective view of an LED lamp when in a use state.

Referring to FIG. 1 through FIG. 6, an LED lamp 10 according to an embodiment the present disclosure is shown. The LED lamp 10 is configured to be assembled to a ceiling. A lamp panel 62 for a magnet absorbing is assembled to the ceiling. The LED lamp 10 includes a lamp base 20, an LED light source module 30 assembled to the lamp base 20, a transparent lampshade 40, at least two magnets 50, and two end caps 53. The lamp base 20 has an elongated shape. When in use, the LED lamp 10 is assembled to the lamp panel 62 via the lamp base 20 and the magnets 50, and is connected to a power source 63 via an electric wire 64. When it is required to provide a lighting function, the LED light source module 30 works to give out light, and the light is divergent toward a periphery via the transparent lampshade 40. It can be understood that the lamp panel 62 is made of metal which can be absorbed by the magnet, the metal can be iron, cobalt or nickel. In the present disclosure, the lamp panel 62 is a ferric lamp panel of the original fluorescent lamp which is assembled to the ceiling via a bracket 61.

The lamp base 20 defines a receiving groove 21 receiving the LED light source module 30, and two latching grooves 22 receiving the transparent lampshade 40. In order to enhance the heat dispersion, the lamp base 20 is provided with a plurality of cooling fins 23 and a plurality of cooling ribs 24. A number of the cooling fins 23 is two, the two cooling fins 23 extend downwardly from a bottom surface of the lamp base 20. A number of the cooling ribs 24 is ten, the ten cooling ribs 24 protrude outwardly from a side surface of the lamp base 20. In order to assemble the end caps 53, the two cooling fins 23 and the side surfaces of the lamp base 20 form two receipting grooves 25. The receipting groove 25 can be a groove having arced shape or square shape or other shapes. In the illustrated embodiment, the receipting groove 25 has an arced shape. In order to facilitate the assembling the magnet 50, the lamp base 20 defines two receipting holes 26, the receipting hole 26 is located on a position corresponding to the receiving groove 21. The lamp base 20 includes two protrusion ribs, the two protrusion ribs are parallel arranged, the receiving groove 21 is formed between the two protrusion ribs. The plurality of cooling ribs 24 protrude from outer side surfaces of the two protrusion ribs and form a plurality of cooling grooves, each cooling groove is formed between adjacent two cooling ribs 24. The two receipting holes 26 are defined on the bottom surface of the receiving groove 21. Each cooling fin 23 extends downwardly from a bottom of the protrusion rib.

The LED light source module 30 includes a lamp strip 31 and a plurality of LED lamp chips 32. The plurality of LED lamp chips 32 are arranged on the lamp strip 31. In the illustrated embodiment, the LED lamp chips 32 are evenly distributed. In order to attain a better lighting effect, in alternative embodiment, the LED lamp chips 32 can also be arbitrarily distributed. When assembling the LED light source module 30, the lamp strip 31 is positioned in the receiving groove 21, and is resisted by the transparent lampshade 40 for fixedly positioning the LED light source module 30.

The transparent lampshade 40 has an arc shaped surface, and is provided with two latching strips 41 and two resisting sheets 42. The two latching strips 41 and the two resisting sheets 42 extend inwardly from an inner sidewall of the transparent lampshade 40. The two latching strips 41 are positioned beneath the two resisting sheets 42, and engage the two latching grooves 22 for positioning the transparent lampshade 40, thus the two resisting sheets 42 are positioned above two latching strips 41. The resisting sheet 42 accommodates a degree of flexibility. The resisting sheet 42 resists opposite sides of the lamp strip 31 of the LED light source module 30 to position the lamp strip 31.

The at least two magnets 50 are mounted on opposite ends of the bottom surface of the lamp base 20. The two magnets are magnetically and adjustably attached to the lamp panel 62. The magnet 50 includes a magnetic head 51 and a connector 52. The magnetic head 51 is sleeved on the connector 52. When assembled, the connector 52 extends through the receipting hole 26 and is fixed to the lamp base 20, and then the connector 52 inserts into the magnetic head 51. The end cap 53 defines a plurality of assembly holes 54, the two end caps 53 are mounted on opposite ends of the lamp base 20 via the assembly holes 54 and the receipting grooves 25. The connector 52 includes a shaft 521 and a flange 523 extending outwardly from a periphery of an end of the shaft 521, and the magnetic head 51 has an annular shape and defines an engaging hole 511, the shaft 521 of the connector 52 extends through the lamp base 20 and the engaging hole 511, and is connected to the magnetic head 51, the flange 523 resists the bottom surface of the lamp base 20. end of the shaft 521, and the magnetic head 51 has an annular shape and defines an engaging hole 511, the shaft 521 of the connector 52 extends through the lamp base 20 and the engaging hole 511, and is connected to the magnetic head 51, the flange 523 resists the bottom surface of the lamp base 20.

Aforementioned LED lamp 10 is consisted by the lamp base 20, the LED light source module 30, the transparent lampshade 40, and the magnets 50. The LED light source module 30 is positioned in the receiving groove 21 of the lamp base 20, and is resisted by the resisting sheets 42 of the transparent lampshade 40, enabling the LED light source module 30 to be more stable, and the LED light source module 30 is difficult to loose. Because the magnets 50 are assembled to opposite ends of the bottom surface the lamp base 20, when the fluorescent lamp is disassembled and replaced, merely the fluorescent lamp should be dismantled from the lamp panel 62 which is mounted on the bracket 61, and the power source 63 having corresponding parameters is assembled, and then the LED lamp 10 is absorbed on a bottom of the original lamp panel 62. Because the magnets 50 on the lamp base 20 have a strong magnetic attractive force for the lamp panel 62, thus the lamp base 20 can be absorbed on the lamp panel 62 stably, the assembly of the lamp base 20 is convenient, and the original lamp panel 62 can be utilized. Thereby, it is cost saving and practical.

Technical features of above embodiments can be combined arbitrary, for simple, any combination of every technical feature in above embodiments is not all illustrated. However, the technical features which are not contradicted to each other may fall into the scope of the specification.

The above are several embodiments of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. An LED lamp, comprising:

a lamp panel mounted on a ceiling;

a lamp base having an elongated shape;

an LED light source module mounted on the lamp base;

a transparent lampshade comprising two resisting sheets extending inwardly from an inner sidewall thereof, the two resisting sheets resisting the LED light source module to position the LED light source module; and two magnets mounted on opposite ends of a bottom surface of the lamp base, respectively, the two magnets being magnetically attached to the lamp panel;

wherein each magnet comprises a magnetic head and a connector, the connector comprises a shaft and a flange extending outwardly from a periphery of an end of the shaft, the magnetic head has an annular shape and defines an engaging hole, the shaft of the connector extends through the lamp base and the engaging hole, and is connected to the magnetic head, the magnetic head resists a top surface of the lamp base;

wherein the connector is a one-piece unit, the shaft lacks threads, the flange is a head integral with the shaft such that the head resists the bottom surface of the lamp base.

2. The LED lamp according to claim 1, wherein the lamp base defines a receipting hole, the connector extends through the receipting hole and is connected to the magnetic head.

3. The LED lamp according to claim 1, wherein the lamp base defines a receiving groove receiving the LED light source module, and two latching grooves on opposite sides of the receiving groove, the transparent lampshade is further provided with two latching strips, the two latching strips extend inwardly from an inner sidewall of the transparent lampshade, the two latching strips are positioned beneath the two resisting sheets and engage the two latching grooves.

4. The LED lamp according to claim 1, further comprising two end caps, wherein each end cap defines a plurality of assembly holes, the end caps are mounted on opposite ends of the lamp base via the plurality of assembly holes.

5. The LED lamp according to claim 1, wherein the lamp base is provided with a plurality of cooling fins and a plurality of cooling ribs, the cooling fins extend downwardly from a bottom surface of the lamp base, the cooling ribs protrude outwardly from side surfaces of the lamp base.

6. The LED lamp according to claim 5, wherein the cooling fins and the side surfaces of the lamp base form two receipting grooves.

7. The LED lamp according to claim 1, wherein the LED light source module comprises a lamp strip and a plurality of LED chips arranged on the lamp strip.

8. An LED lamp, comprising:

a lamp panel mounted on a ceiling;

a lamp base having an elongated shape;

an LED light source module mounted on the lamp base;

a transparent lampshade comprising two latching strips extending inwardly from an inner sidewall thereof; and two magnets positioned on opposite ends of a bottom surface of the lamp base, respectively, the two magnets being magnetically attached to the lamp panel;

wherein the lamp base defines a receiving groove receiving the LED light source module, and two latching grooves on opposite sides of the receiving groove, the two latching strips engage the two latching grooves;

each magnet comprises a magnetic head and a connector, the connector comprises a shaft and a flange extending outwardly from a periphery of an end of the shaft, the magnetic head has an annular shape and defines an engaging hole, the shaft of the connector extends through the lamp base and the engaging hole, and is connected to the magnetic head, the magnetic head resists a top surface of the lamp base;

wherein the connector is a one-piece unit, the shaft lacks threads, the flange is a head integral with the shaft such that the head resists the bottom surface of the lamp base.

9. The LED lamp according to claim 8, wherein the transparent lampshade further comprises two resisting sheets extending inwardly from the inner sidewall of the transparent lampshade, the two resisting sheets are positioned above the two latching strips, the two resisting sheets resist the LED light source module to position LED light source module.

* * * * *